US006387874B1

(12) United States Patent
Schalitz et al.

(10) Patent No.: US 6,387,874 B1
(45) Date of Patent: May 14, 2002

(54) CLEANING COMPOSITION CONTAINING AN ORGANIC ACID AND A SPORE FORMING MICROBIAL COMPOSITION

(75) Inventors: William John Schalitz, Whitehouse; Jason J. Welch, Perrysburg; Ronald Thomas Cook, Bowling Green, all of OH (US)

(73) Assignee: Spartan Chemical Company, Inc., Toledo, OH (US)

( * ) Notice: Subject to any disclaimer, the term of this patent is extended or adjusted under 35 U.S.C. 154(b) by 0 days.

(21) Appl. No.: 09/893,254

(22) Filed: Jun. 27, 2001

(51) Int. Cl.[7] ..... C11D 3/386; C11D 1/825; C11D 1/62

(52) U.S. Cl. ..... 510/530; 510/199; 510/226; 510/238; 510/253; 510/300; 510/305; 510/319; 510/362; 510/382; 510/384; 510/391; 510/504; 510/530; 510/289; 510/356; 510/421

(58) Field of Search ..... 510/384, 199, 510/226, 238, 300, 305, 319, 362, 382, 391, 504, 530, 253, 289, 356, 421

(56) References Cited

U.S. PATENT DOCUMENTS

| | | | | |
|---|---|---|---|---|
| 4,404,128 A | | 9/1983 | Anderson | |
| 4,655,794 A | | 4/1987 | Richardson et al. | |
| 4,839,373 A | | 6/1989 | Ito et al. | |
| 5,409,546 A | | 4/1995 | Nakagawa et al. | |
| 5,449,619 A | * | 9/1995 | Griffin et al. | 435/264 |
| 5,731,278 A | | 3/1998 | Nair et al. | |
| 5,863,882 A | * | 1/1999 | Lin et al. | 510/397 |
| 6,165,965 A | | 12/2000 | Schalitz et al. | |

FOREIGN PATENT DOCUMENTS

| | | |
|---|---|---|
| WO | WO 97/16541 | 5/1997 |
| WO | WO 97/25865 | 7/1997 |
| WO | WO 97/38586 | 10/1997 |
| WO | WO 99/16854 | 4/1999 |

OTHER PUBLICATIONS

Spartan Chemical Company, Inc., NABC Plus IV, Published May 1993, Spartan Chemical Company, Inc. Toledo, USA.
Spartan Chemical Company, Inc., Published May 1998, Bulletin: SparCling, Spartan Chemical Company, Inc. Toledo, USA.
Spartan Chemical Company, Inc., Published Feb. 2000, Bulletin: Foamy Q & A, Acid Disinfectant Cleaner, Spartan Chemical Company, Inc. Toledo, USA.

* cited by examiner

*Primary Examiner*—Charles Boyer
(74) *Attorney, Agent, or Firm*—Reising, Ethington, Barnes, Kisselle, Learman & McCulloch, P.C.

(57) ABSTRACT

Described is an aqueous cleaning composition comprising:

an effective mineral dissolving amount of an organic acid of at least 5% by weight of the cleaning compositions;

an effective amount of a spore forming microbial composition;

an effective cleaning amount of a blend of wetting agents, the first wetting agent having a hydrophobic/lipophobic number (HLB) of about 10 and higher and a second wetting agent having an HLB number of about 5 or less;

an effective amount of a thickening agent and water.

The composition is also available in powder form without the thickening agent.

15 Claims, 2 Drawing Sheets

CLEANING COMPOSITION CONTAINING AN ORGANIC ACID AND A SPORE FORMING MICROBIAL COMPOSITION

TECHNICAL FIELD

The present invention is concerned with a cleaning/-disinfecting composition incorporating spore forming microbiological bacteria.

BACKGROUND OF THE INVENTION

Many residential homes, institutions and commercial facilities are located in geographic areas where water quality and effluent wastewater disposal concerns can cause serious conflict between the type of chemicals used to provide the best cleaning and yet not disrupt the waste treatment operation.

Poor water quality, in the form of mineral hardness, results in the development of surface deposits in areas of frequent water contact such as commodes, urinals, sinks, fountains and bathing/shower facilities. These mineral deposits not only detract from general appearance and implied hygienic conditions, but can also cause permanent damage to fixtures over time. The common response to this problem is repetitive use of cleaners with high acid content. The most prevalent products in both the retail and industrial markets utilize mineral acids such as hydrochloric, phosphoric and in some cases, sulfuric. Although very effective at removal of hard water deposits, continual use of these types of products can cause serious issues with the biomass of downstream wastewater treatment.

This possible "downstream" effect is a major concern for facilities relying on in-house wastewater treatment systems. The operating efficiencies of these treatment systems, including anything from fully engineered complete treatment plants to partial treatment systems and septic tanks, can easily be compromised due to the diminished dilution effect offered by the smaller volume of effluent associated with these facilities. Continual use of strong acid bowl cleaners and other products utilized in general facility maintenance tends to destabilize a treatment system's resident biomass through altering the environment. The natural recovery of a destabilized or shocked biomass can take days to occur during which a treatment system continues to build up with organics and possibly operate outside of permit standards.

Biological based products not only offer facilities a method of quickly re-establishing a system's biomass after shocks, but they are also becoming more prevalent as a means to prevent such situations and improve overall performance through continual maintenance dosages. Continual treatment with a biological based product provides enhanced abilities to handle difficult to degrade compounds, reduce solids loading, improve removal of FOG's (fats, oils & greases) and extend the time period between physical pump-outs in certain systems such as septic tanks.

Current technology does not offer a product or method by which water hardness deposits can be efficiently removed from surfaces while concurrently providing viable bacterial cultures to the facility's waste collection and/or treatment system.

The object of the invention is to provide a product suitable for removal of hard water deposit and general cleaning that through use will actually augment the activity of on-site wastewater treatment operations instead of interfering as can occur in many cases. The product is a combination of an acid based cleaner/disinfectant that incorporates a stabilized culture of bacterial spores.

The utilization of the microbial materials is to destroy offensive odors and their source that may be present on a surface. In addition, the microbial materials provide preventative maintenance for the wastewater collection system and improved activity in downstream treatment plants. The purpose of the antimicrobial component is to kill various types of microorganisms found on the surface which might pose health concerns or contribute to nuisance odors. A particularly important aspect of formulating antimicrobial products is that they remain stable for a long period of time. The microbiological materials likewise need to be stable in the presence of the other components of a cleaning composition such as the quaternary ammonium compounds.

It is an object of the present invention to obtain an effective disinfectant and hard surface cleaning composition that is aqueous based.

It is an object of the present invention to obtain and utilize in combination a disinfectant, hard surface cleaning, and bacterial composition that is stable for a long period of time, but also allows the microbial material to remain active after the intended use of the product.

It is an object of the present invention to utilize an aqueous composition containing bacteria from the genus Bacillus in the presence of disinfectants such as quaternary ammonium compounds.

It is an object of the present invention to perform general cleaning tasks in a more efficient manner, whereby the multi-step cleaning process to clean, disinfectant and control odors on hard surfaces is decreased. The utilization of this invention will permit the saving of labor time and reduce chemical inventory.

It is an object of the present invention to utilize compositions that contain a bacterial content that provides better environmental fate attributes to both on site waste treatment systems and municipal treatment plants through biological augmentation of the indigenous bio-mass.

The following references may be pertinent to the invention disclosed herein.

U.S. Pat. No. 6,165,965 describes aqueous disinfectant cleaning composition using a Bacillus microorganism.

PCT Publication W097/25865 pertains to a sanitizing composition containing surfactant, a chelating agent, a preservative, a thickening agent and a Bacillus microorganism.

U.S. Pat. No. 5,449,619 pertains to a drain opener formulation containing a Bacillus microorganism and a surfactant as well as a preservative.

U.S. Pat. No. 4,839,373 pertains to preservative composition containing quaternary ammonium compounds in conjunction with a specific preservative, which is a derivative of benzothiazole in specific ratios.

U.S. Pat. No. 4,404,128 pertains to an enzyme detergent composition where the enzyme is a proteolytic enzyme.

U.S. Pat. No. 4,655,794 pertains to a liquid cleaning compound containing abrasive particles plus viable microorganisms. Such as, Bacillus, a detergent, thickener and an anti-settling agent. The composition is a cleaning composition.

U.S. Pat. No. 5,409,546 pertains to a method for cleaning and disinfecting contact lens wherein there is a preservative which is a serine protease derived from bacteria belonging to the genus, Bacillus, a metal chelating agent and boric acid. Non-ionic surfactants are also described.

U.S. Pat. No. 5,731,278 described heavy-duty laundry detergents containing surfactants, non-surface active liquid carrier compositions, viscosity enhancing agents and enzymes.

PCT Publication W097/16541 described an alkaline protease, which describes a strain of Bacillus and which shows a stability in the presence of surfactants.

PCT Publication W097/38586 discloses a method of preventing the growth of microorganisms other than Salmonella on meat products by contacting the meat product with a microbial growth inhibiting amount of a quaternary ammonium compound together with a microorganism, such as Bacillus.

International PCT Publication W099/16854 presents a ready to use thickened acid cleaner and disinfectant.

Numerous antibacterial compositions are available in the trade which do not contain the spore forming compositions as described herein. Such materials are Foamy Q&A (trademark of Spartan Chemical Company) for an acid disinfectant cleaner containing phosphoric acid and alkyl dimethyl benzyl ammonium chlorides with a pH of less than 2. See also NABC plus IV (trademark of Spartan Chemical) for a natural acid bowl and porcelain cleaner having a pH of 1.5–2 containing citric acid. See also SparCling (trademark of Spartan Chemical) for a restroom disinfectant containing hydrogen chloride and N-alkyl dimethyl benzyl ammonium chlorides.

SUMMARY OF THE INVENTION

Figure 1:
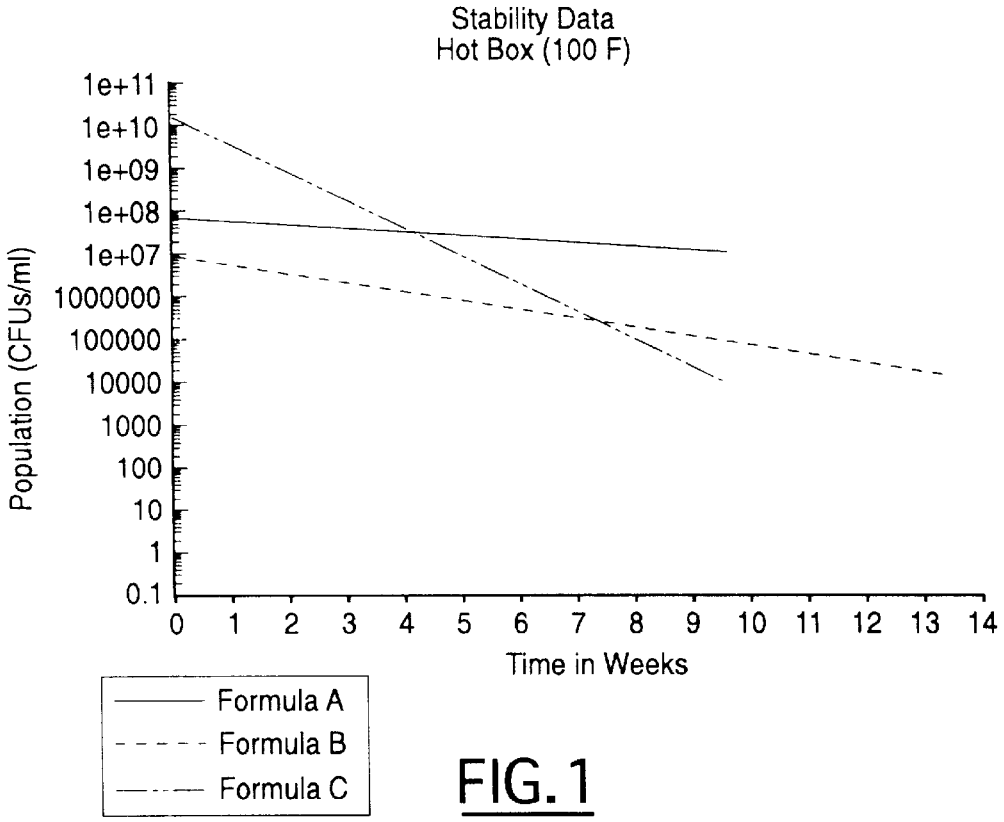
FIG. 1 is a chart reflecting long-term stability testing of formulations identified in Table 1.

Described is an aqueous cleaning and disinfecting composition comprising:

an effective mineral dissolving amount of an organic acid of at least 1% by weight of the cleaning compositions;

an effective amount of a spore forming microbial composition;

an effective cleaning amount of a blend of wetting agents, the first wetting agent having a hydrophobic/lipophobic number (HLB) of about 10 and higher and a second wetting agent having an HLB number of about 5 or less;

an effective amount of a thickening agent and water

Also described is a method of cleaning a soiled hard surface comprising applying the above composition to the surface and drying the surface thereby cleaning the surface.

The composition as described above is particularly useful for the overall desires of the present application for cleaning and disinfecting hard surfaces.

Also described is a powder composition containing the active ingredients of the organic acid, spore forming microbial composition, blend of wetting agents plus additional filler.

DESCRIPTION OF PREFERRED EMBODIMENTS

The aqueous disinfectant and hard surface cleaning composition of the present invention utilizes an effective disinfecting amount of a quaternary ammonium compound. The ammonium compound is a cationic detergent, which provides excellent activity against bacteria, fungi and enveloped viruses. Additionally, quaternaries offer consistent efficacy in the presence of poor water quality and organic soil load conditions. For a more detailed listing of enveloped viruses, see Fields Virology, $2^{nd}$ Edition 1990.

The formulation for cleaning composition of the present invention is as follows:

| NAME | AMOUNT (% by wt.) | PREFERRED AMOUNT |
|---|---|---|
| Organic Acid | 1–10% | 8.0% |
| Microbiological Material | $5 \times 10^{10}$–$1 \times 10^{12}$ CFU/gallon | $5.0 \times 10^{11}$ CFU/gallon |
| Blend of Wetting Agents | | |
| High HLB | 0.1% to 5.0% | 0.75% |
| Low HLB | 0.1% to 5.0% | 0.25% |
| Thickening Agent | 0.1% to 10% | 0.15% |
| Water | Remainder | Remainder |
| Total | 100% | |

The pH of the composition as utilized in aqueous condition is about 2 or less.

The compositions of the present application can easily be utilized to meet the cleaning performance requirements of different testing techniques. An example of such testing technique is cleaning verification as described in ASTM D 4488-95 where the natural or accelerated aging of soil such as baked on greasy soil may be utilized to correlated with actual use. Other actual use tests to determine antimicrobial efficacy are the SARC (semi-automatic ring carrier) modification to and actual AOAC Official Methods Of Analysis, $15^{th}$ Edition, 1990.

Other components may be added to the composition without materially modifying the composition such as colorant and fragrance.

By "disinfecting" is meant removal of microorganisms, i.e., unicellular materials as protozoan, bacterium, virus or fungi.

Antimicrobial quaternary materials are available to the trade.

There are three principal suppliers of quaternary based antimicrobials that are registered as actives for this type of use with the EPA. These companies are Lonza, Stepan and Mason Chemical Company. The trade names under which they are marketed are Bardac, BTC and Maquat respectively. All of the desirable quaternary material sold conform to one of the following families:

First Generation: $C_6H_5$—$CH_2N(CH_3)_2R$ Alkyldimethylbenzyl ammonium chloride Second Generation: $(C_2H_5)C_6H_5$—$CH_2N(CH_3)_2R$ Alkyldimethylethylbenzyl ammonium chloride Third Generation: $N(R)_2(CH_3)_2$. R-dimethyl ammonium chloride The preferred cationic detergent is from the quaternary ammonium chloride family such as the BTC (trademark) materials from Stepan Chemical including dialkyl of from 6–18 carbon atoms dialkyl of from 1–4 carbon atoms ammonium chloride; preferably didecyl dimethyl ammonium chloride, dioctyl dimethyl ammonium chloride, octyl decyl dimethyl ammonium chloride and alkyl ($C_{14}$-50%, $C_{12}$-40%, $C_{16}$-10%) dimethyl benzyl ammonium chloride. Even more preferably is a blend of the ammonium chloride materials as recited below.

The system utilized in this product is designed to maximize all of the beneficial aspects of quaternary ammonium compounds and consists of the following blend in a 1:1:2:2.67 wt. ratio respectively:

1. Didecyl dimethyl ammonium chloride (BTC 818) (Trademark of Stepan Chemical)
2. Dioctyl dimethyl ammonium chloride (BTC818) (Trademark of Stepan Chemical)
3. Octyl decyl dimethyl ammonium chloride (BTC 818)
4. Alkyl ($C_{14}$-50% by wt, $C_{12}$-40% by wt, $C_{16}$-10% by wt) dimethyl benzyl ammonium chloride. (BTC 835) (Trademark of Stepan Chemical)

During use as a disinfecting composition, the total levels of this blend (1–4) will preferably range from 500 to 1000 ppm's (parts by weight per million).

Other quaternary materials that may be utilized are Tomah quaternaries (trademark of Tomah Products of Milton, Wis. for quaternary ammonium materials).

Tomah quaternaries are based on the reaction of high molecular weight aliphatic tertiary amines with an alkylating agent such as methyl chloride. Quaternaries are more cationic and more stable to pH change than other amine-based surfactants such as ethoxylated amines or amine acetate salts. The different molecular configurations give different solubility, emulsification, and cationic strength properties.

Most Tomah Quaternaries can be represented by the formula where R is an aliphatic hydrophobe.

$$RO(CH_2)_3N^+(CH_3)(C_2H_4OH)_2Cl^-$$

R is an aliphatic alkyl of hydrophobe (of from 6–18 carbon atoms)

Other useful quaternary ammonium materials from Tomah are:

Q-14-2 75% active isodecyloxypropyl dihydroxyethyl methyl ammonium chloride;

Q-14-2PG 75% active isodecyloxypropyl dihydroxyethyl methyl ammonium chloride (supplied in propylene glycol);

Q-17-2 75% active isotridecyloxypropyl dihydroxyethyl methyl ammonium chloride;

Q-17-2PG 75% active isotridecyloxypropyl dihydroxyethyl methyl ammonium chloride (supplied in propylene glycol);

Q-18-2(50) 50% active octadecyl dihydroxyethyl methyl ammonium chloride;

Q-18-15 100% active octadecyl poly (15)oxyethylene methyl ammonium chloride;

Q-D-T 50% active tallow diamine diquatemary;

Q-DT-HG 70% active tallow diamine diquatemary (supplied in hexylene glycol);

Q-C-15 100% active coco poly(15)oxyethylene methyl ammonium chloride; and

Q-ST-50 50% active trimethyl stearyl quaternary ammonium material.

The present invention utilizes an effective amount of a spore forming microbial composition. The biological products that are desirable with the present invention are in liquid or lyophilized form and are generally based upon the bacteria from the genus Bacillus. These organisms are preferred because they are easy to be formulated due to their ability to go into a dormant spore state. In addition, the organic degradation abilities of certain species within the Bacillus genus are appropriate for the types of applications described herein for cleaning purposes. Further, the Bacillus bacteria lend themselves readily to large scale fermentation. The bacterial content of the formulations as described herein are desirable based upon their stability in the presence of the other components of the formulation, in particular, the antimicrobial quaternary and/or organic acid materials. Preferred organisms are *Bacillus amyloliquefaciens, Bacillus licheniformis, Bacillus megaterium* and *Bacillus subtilis* (Preferably a blend of the materials is used). These products are commercially available from a number of sources. The preferred materials of the Bacillus genus can be obtained from Semco Laboratories, Inc. available under the name Sporzyme 1B, Sporzyme Ultra Base 2, Sporzyme EB and Sporzyme BCC (all trademarks of Semco Laboratories for liquid materials containing bacterial spores of the Bacillus genus). The Bacillus genus materials are also available from Sybron Chemicals, Inc. of Wilmington, Del.

The invention is a ready-to-use thickened natural acid bowl cleaner/disinfectant that incorporates viable microbial spores for augmentation of downstream wastewater treatment systems.

Cleaning performance of the product is principally attributed to the surfactant content of the formulation. The surfactants used are a combination of both high and low HLB linear alcohol ethoxylate blended at a 3:1 ratio, respectively. This system provides improved wetting and emulsification characteristics over most single surfactant systems. Other nonionic surfactants and most amphoterics are also compatible with the system and possible materials for use. In formulations not incorporating cationic antimicrobials, anionic surfactants such as sodium lauryl sulfonate and sodium dodecylbenzene sulfonate can be utilized.

Thickening of the formulation is required for two purposes. The first function is to improve the stability of the bacterial spore dispersion. Over a relatively short period of time, the spores in most liquid systems will settle out. Adding viscosity to the liquid product provides suspension properties to help stabilize the spore dispersion and keep the product efficacy more consistent throughout use. In the case of a ready-to-use acid bowl cleaner, the viscosity also provides the ability for the product to cling to vertical surfaces such as urinals and commodes. Vertical cling allows extended contact time with the soiled surfaces improving cleaning performance. Various amide chemistries, amine oxides and nonionic associative thickeners can be utilized to obtain this attribute in systems requiring compatability with cationic materials. In non-cationic systems, anionic thickeners like xantham gum can be used effectively.

The microbial content of the product is generally based on various species of bacteria from the Genus Bacillus. The ability of these bacteria to form a very resistant spore makes them easy to formulate into cleaning products. Specifically, we have found that the spore state provides certain species stability in the acidic environment of the present formulation. These particular species also have desirable waste degradation capabilities for the augmentation of downstream waste systems such as septic tanks and package plants.

Antimicrobial properties of the formulation are a function of the organic acid alone or in conjunction with quaternary ammonium chloride compounds. Quaternary compounds provide excellent activity against bacteria, fungi and enveloped viruses. They also offer efficacy in situations of poor water quality and organic loading due to soiled surfaces. This formulation can utilize a variety of the readily available antimicrobial quaternary compounds on the market (typically classified as $1^{st}$ through $4^{th}$ generations quat systems). Organic acids provide additional antimicrobial activity through disruption of the cell membrane and enzymatic activity. Ideal organic acids to utilize include lactic, citric and/or glycolic acid.

The organic acid in the formulation also serves a role in the cleaning efficacy of the product. General surfactants do not have the ability to remove surface deposits and stains that result when bathroom and other fixtures are in consistent contact with poor quality water. Organic acids provide a means to remove such deposits as calcium carbonate and iron oxides from the surfaces that is typically safer to the user and downstream waste treatment system than mineral acid based products.

These same general chemistries, minus the thickening agent, can also be formulated into a powdered or solid type product as shown in the table below.

| NAME | AMOUNT (% by wt.) | PREFERRED AMOUNT | PURPOSE |
|---|---|---|---|
| Organic Acid Ahydrous | 1–90% | 8.0% (at use) | Cleaning and Disinfecting |
| Microbiological Material | $5 \times 10^9$–$1 \times 10^{12}$ CFU/gram | $5.0 \times 10^9$ CFU/gram | Biological activity |
| Blend of Wetting Agents | | | |
| High HLB | 0.1% to 5.0% | 0.75% (at use) | Wetting agents |
| Low HLB | 0.1% to 5.0% | 0.25% (at use) | |
| Inorganic clay, such as Kaolin | 5% to 10% | 5% | Abrasive for cleaning |
| Sodium citrate | 10% to 20% | 10% | Carrier/filler |

Charge the blender with the required amount of sodium citrate and clay. Next, add the total amount of acid in combination with the spray dryed or prilled surfactants. By prilled is meant a pellitized material. The last addition is the bacterial cultures. Allow the blender to run 30–40 minutes to ensure equal dispersion.

In use, the dry material can be applied as is or in a preportioned container or diluted with water. If diluted with water, the amount of dilution preferably maintains about 8% by weight of the organic acid material.

This invention provides home owners on septic tanks and facilities responsible for their own wastewater treatment a means to effectively clean restrooms and other areas while simultaneously biologically augmenting the waste handling system. In comparison to the typical mineral acid based products on the market, this formulation is less hazardous to the end-user and has a much better environmental fate profile with less chance of disrupting the biological activity of downstream waste treatment. Facilities that utilize septic tanks for waste treatment will realize a diminished need for pump-outs and with consistent use can eliminate the need to purchase separate microbial based products designed to augment bio-activity.

The principal wetting agent that may be utilized in the present invention is one that has an HLB number of at least 10. Suitable materials are recited in McCutcheon's Emulsifiers and Detergents North American Edition Volume I for the year 2000, published by the Manufacturing Confectioner Publishing Company of Glenrock, N.J. One of skill in the art can select the desired materials from the host of materials recited in the McCutcheon book. Some materials that may be utilized are alkoxylated alcohols where the alcohols have from 1–6 carbon atoms, and the oxylated materials have from 1–3 carbon atoms. Suitable materials are linear alcohol ethoxylate which are generally considered nonionic surfactants, amphoterics and the like. Other materials that may be utilized are polyethylene glycol dioleate, polyoxylated ester surfactants, octylphenol ethoxylate, dodecylphenol ethoxylate and the like. Those having an ILB of 12 and above include ethoxylated amine such as Triton RW-50, ethoxylated oleyl alcohol such as Ameroxo OE-10, ethoxylated stearic fatty acid, such as Chemax E 400-MS, N-stearoyl sarcosine, such as Hamposyl S and the like. Those having a HLB of 13 and higher include nonyl phenoxy (polyethyleneoxy) ethanol; nonoxynol-9, such as Igepal CO-630 and the like.

Those having an HLB number of 5 or less include Cetyl dimethicone copolyol such as Abil Em 90 ethoxylated linear alcohols (such as 25% ethylene oxide) such as Alfonic 1216CO-1.5; oleyl alcohol ethoxylate such as Genapol of 020 and the like; sorbitan monostearate as Glycomul S and the like.

Preferred surfactant materials for the invention are a blend of low and high HLB linear ($C_{11}$) alcohol ethoxylates.

The thickening agent is any agent that can be utilized to increase viscosity of the composition. See a variety of thickening agents disclosed and discussed in McCutcheon's 2000, entitled Functional Materials North American Edition Volume II, published by the Manufacturing Confection Publishing Company of Glenrock, N.J. Suitable thickening agents include ethoxylated soyarnine, linoleic diethanolamide, such as Alkamide din 295/S (a trademark of Rhodia, Inc.); Alkamide KD, trademark of Rhodia for super coconut fatty diethanolamide; Antil HS 60, trademark of Goldschmidt Chemical Corp. for Cocamidopropyl betaine and glyceryl laurete; Antil 127, trademark of Goldschmidt Chemical Corp. for polyethylene glycol –120 methylglucose dioleate; Aqualon cellulose gum, trademark of Hercules Inc. for sodium carboxy methyl cellulose; Barlox 14, trademark of Lonza Inc. for myristamine oxide; Benathix, trademark of Rheox Inc. for an organically modified montmorillonite clay; Bentolite, a trademark of Southern Clay Products for purified bentonite; Bentone EW, trademark of Reox for chemically modified magnesium silicate; Bentone MA, trademark of Reox for magnesium aluminum silicate; Carbopol ETD, trademark of B.F. Goodrich for polyacrylic acid polymer, cross link; Cyanamer A-370, trademark of Cytec Industries for modified polyacrylamide; Foramid SCE, trademark of Alzo International Inc. for cocamide DEA (diethanolamine); Kelflo, trademark of Monsanto Company for Xantham gum/limestone blend; Lexemul 515m trademark of Inolax Chemical Company for glyceryl stearate; Natrosol 250 ER, trademark of Hercules Inc. for hydroxyethyl cellulose and the like.

The organic acids that may be utilized in the present application are those that are mono or polycarboxylic acids such as those having from 1–12 carbon atoms such as ethanoic, butanoic, hexanoic, dexanoic acid and the like or polycarboxylic acid such as citric acid, glycolic, lactic acid, and the like.

The acids that are utilized should be water soluble.

An additional component utilized in the disinfectant cleaning composition of the present invention is a surfactant. The use of surfactants is to assist in decreasing the surface tension of water and remove soils from the substrate. A particularly desirable group of surfactants are those that maintain the stability of the cationic disinfectant and the microbiological materials. The surfactants that are preferably utilized are non-ionic and amphoteric materials. These materials provide efficient wetting of the substrate to be cleaned, emulsification of oily soils and are jonically compatible with the cationic components of the cleaning composition.

Non-ionic materials that may be utilized include fatty amines or oxides, fatty alkanolamides, alkyl polyglucosides and linear alcohol ethoxylates. Preferred surfactants are secondary alcohol ethoxylates, betaines, sultaines and amine oxides. Preferred alcohol ethoxylates and ethoxysulfates are available under the trademark Tomadol (trademark for surfactants of Tomah). Tomadol products include linear primary alcohols in a $C_9$–$C_{15}$ alkyl range, ethoxylate non-ionic surfactants and ethoxy sulfate.

Further examples of non-ionic surfactants are materials known as Igepal (trademark of Rhodia, Inc. for nonyl phenoxy polyethoxy ethanol); Tergitol NP (trademark of Union Carbide Corp. for nonylphenol ethoxylate); Tergitol 15-S (trademark of Union Carbide Corp. for secondary alcohol ethoxylates); Triton X series (trademark of Union Carbide Corp. for octyl phenol polyethoxylate) and Tween Materials (trademark of ICI Americas, Inc. for polyoxyethylene (20) sorbitan monostearate and polyoxyethylene sorbitan monooleate). Examples of amphoteric materials include Mirataine CBC and Miranol C2MSF (trademark of Rhodia, Inc. for surfactant) and Lexaine (trademark of Inolex Co. for cocoamidopropyl betaine).

In order to maintain the stability of the dispersion of the microbiological spores that are utilized in the present case and to prevent the spores from settling out, which causes a loss in the effectiveness of a product, thickening agents are utilized. The thickening agents that are desirable are those that are compatible with cationic systems. A preferred thickening agent is a cellulosic material such as hydroxyethylcellulose. Preferred are Natrosol (trademark of Hercules for non-ionic water soluble polymer hydroxylethyl cellulose) and Cellosize (Trademark of Union Carbide for hydroxymethylcellulose).

An additional thickening agent that may be used is Acusol 880/882—(Trademark of Rohm and Haas Co. for nonionic associative polymer mixture of polyethylene glycol, propylene glycol and water having a pH of 7–9 and a viscosity of 60,000 CPS maximum).

A preferred formulation is recited below.

ORGANIC ACID DISINFECTANT WITH SPORES

| Ingredient Alternatives | % by Weight | Purpose |
|---|---|---|
| Water | 78.74% | Solvent/Carrier |
| Citric acid (50% active) or other natural acids | 12.0% | Cleaning and Disinfecting |
| N-alkyl dimethyl benzyl ammonium chloride Quaternary Ammonium Chlorides | 0.8% | Antimicrobial |
| Linear alcohol ethoxylate (7 moles ethylene oxide; e.o.) Nonionic surfactants, amphoterics, etc. | 0.38 | Wetting Agent |

-continued

ORGANIC ACID DISINFECTANT WITH SPORES

| Ingredient Alternatives | % by Weight | Purpose |
|---|---|---|
| Linear alcohol ethoxylate (3 moles e.o.) Nonionic surfactants, amphoterics, etc. | 0.12% | Wetting Agent |
| Ethoxylated soyamine Nonionic thickening agents | 5.0% | Thickener |
| Sodium Chloride | 2.7% | Associative Thickener (The disassociated ions assist in the thickening characteristics of the S-12 soyamine) |
| Bacterial Spores | 0.01% | Biological Activity |
| Fragrance | 0.25% | End-user appeal |
| Dye | 0.001% | End-user appeal |

Mixing Instructions:

First, add the water and disperse the thickening agent slowly and evenly to the water. Avoid large clumps of thickening agent. Mix well for approximately ten minutes or until the thickening agent is hydrated or dispersed. Next, add the surfactant system, mix well for ten minutes or until there are no chunks of undispersed surfactant. Continue by adding the quantemary compounds if used and fragrance. Mix until solution becomes clear. Next add the total amount of organic acid. Finally, mix the fmal water and the bacterial cultures in a separate container. When the Bacterial cultures are completely hydrate, add to the batch. Last, add the dye and mix until dispersed The compositions of the present application can easily be utilized to meet the cleaning performance requirements of different testing techniques. An example of such testing technique is cleaning verification as described in ASTM D 4488-95 where the natural or accelerated aging of soil such as baked on greasy soil may be utilized to correlated with actual use. Other actual use tests to determine antimicrobial efficacy are the SARC (semi-automatic ring carrier) modification to and actual AOAC use-dilution method for testing disinfectants. See the AOAC Official Methods Of Analysis, $15^{th}$ Edition, 1990.

It has been found particularly useful in the testing of Applicant's compositions to utilize nisin in a modification to the AOAC method compositions. Nisin is an antibiotic containing 34 amino acid residues, produced by *Streptomyces lactis.*

Explanation of Nisin:

Nisin is not an ingredient in the product formulation. It is a modification to the AOAC test method. Specifically, when setting up the test sub-culture 0.1 $\mu$g/ml of nisin is added to the letheen broth. This level of nisin shows no bacteriostatic effect on the test organism, but inhibits outgrowth of any Bacillus spores which are transferred over on the carrier from the test solution.

The standard "use-dilution" test was run against *Staphylococcus aureus, Pseudomonas aeruginosa, Salmonella choleraesuis* and *Escherichia coli*. The inventive composition are described below satisfactorily passed such tests.

Other components may be added to the composition without materially modifying the composition such as colorant and fragrance.

While the forms of the invention are described above, preferred examples are described below wherein all parts are in % by weight and in degrees centigrade, unless otherwise indicated.

EXAMPLES

1. Formulations Prepared as are Recited Below in Table 1

TABLE 1

| Ingredient | Formula A | Formula B | Formula C |
|---|---|---|---|
| Organic Acid | 6% Citric | 6% Citric | 5% Glycolic |
| N-alkyl dimethyl benzyl ammonium chloride | 0.4% | 0.1% | 0.1% |
| Alcohol ethoxylate (7 EO) Tomadol 1–7 | 0.38% | 0.38% | 0.38% |
| Alcohol ethoxylate (3 EO) Tomadol 1–3 | 0.12% | 0.12% | 0.12% |
| Soyamine Thickener | 5.0% | 3.0% | 5.0% |
| Bacterial Spores | 0.01% | 0.01% | 0.01% |
| Blend of: | | | |
| *Bacillus subtilis* | | | |
| *Bacillus licheniformis* | | | |
| *Bacillus megaterium* | | | |
| *Bacillus anyloliquefaciens* | | | |
| (Equal ratio of all four) | | | |
| Sodium Chloride | 2.7% | 2.7% | 2.7% |

*All percentages are based on actives % by weight w/ balance water.

The formulations have been subjected to long term stability testing as is recited in FIG. 1 below. FIG. 1 presents the stability data for these formulations.

Example 2

Figure 2:
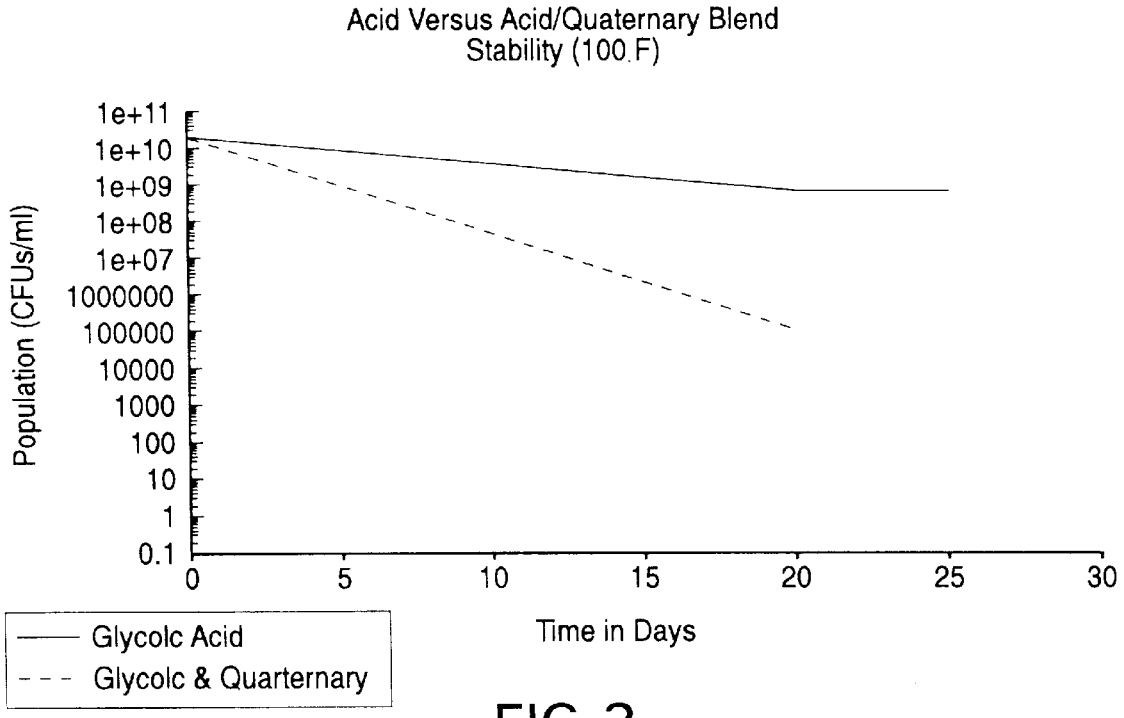
FIG. 2 presents the microbial stability of the formulations described in Table 2.

Microbial Stability in the Presence of Organic Acid with Quaternary Ammonium Chloride versus Organic Acid Only A comparison (Table 2) was made with compositions containing glycolic acid with and without a quaternary. The results are shown in FIG. 2. The presence of the quaternary decreased the long-term stability of the composition.

TABLE 2

| Ingredient | Formulations Formula A | Formula B |
|---|---|---|
| Organic Acid | 6% Glycolic | 6% Glycolic |
| N-alkyl dimethyl benzyl ammonium chloride | 0.1% | 0.0% |
| Alcohol ethoxylate (7 EO) Tomadol 1–7 | 0.38% | 0.38% |
| Alcohol ethoxylate (3 EO) Tomadol 1–3 | 0.12% | 0.12% |
| Soyamine Thickener | 5.0% | 3.0% |
| Bacterial Spores | 0.01% | 0.01% |
| Blend of: | | |
| *Bacillus subtilis* | | |
| *Bacillus licheniformis* | | |
| *Bacillus megaterium* | | |
| *Bacillus anyloliquefaciens* | | |
| (Equal ratio of all four) | | |
| Sodium Chloride | 2.7% | 2.7% |

*All percentages are based on actives % by weight w/ balance water.

FIG. 2 presents the microbial stability for the formulations.

Example 3

Additional Formula and Microbial Stability

Figure 3:
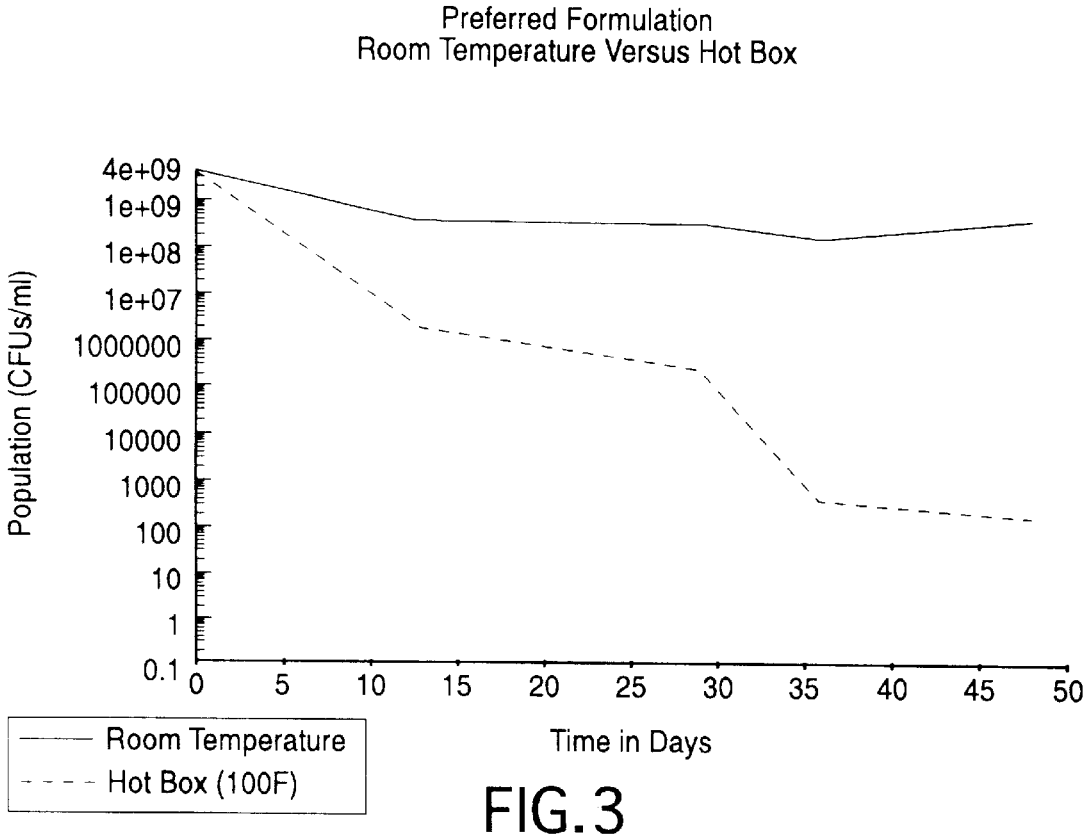
FIG. 3 is a chart reflecting microbial stability of the formulation of Table 3 at two different temperatures over a period of time.

An additional formulation with xanthan gum was prepared (Table 3) with the stability tests shown in FIG. 3.

TABLE 3

| Ingredient | Formulations Formula A |
|---|---|
| Organic Acid | 8% Citric Acid |
| Xanthan Gum | 0.15% |
| Alcohol ethoxylate (7 EO) Tomadol 1–7 | 0.75% |
| Alcohol ehtoxylate (3 EO) Tomadol 1–3 | 0.25% |
| Fragrance | <0.5% |
| Bacterial Spores | 0.02% |
| Blend of: | |
| *Bacillus licheniformis* | |
| *Bacillus anyloliquefaciens* | |
| Dye | Trace |

*All percentages are based on actives % by weight w/ balance water.

FIG. 3 shows microbial stability of a preferred formulation.

While the forms of the invention herein disclosed constitute presently preferred embodiments, many others are possible. It is not intended herein to mention all of the possible equivalent forms or ramifications of the invention. It is understood that the terms used herein are merely descriptive rather than limiting, and that various changes may be made without departing from the spirit or scope of the invention.

What is claimed is:

1. An aqueous cleaning and disinfecting composition comprising:

an effective mineral dissolving amount of an organic acid of at least 1% by weight of the cleaning composition;

an effective amount of a spore forming microbial composition;

an effective cleaning amount of a blend of wetting agents, the first wetting agent having a hydrophobic/lipophobic number (HLB) of about 10 and higher and a second wetting agent having an HLB number of about 5 or less;

an effective amount of a thickening agent and water.

2. The composition of claim 1 further comprising an effective disinfecting amount of a quaternary ammonium compound.

3. The composition of claim 2, wherein the ammonium compound is a dialkyl of from 6–18 carbon atoms, dialkyl of 1 to 4 carbon atoms ammonium compound.

4. The composition of claim 1, wherein the spore forming microbial composition is a Bacillus material.

5. A powder cleaning and disinfecting composition comprising:

an effective mineral disolving amount of an organic acid of at least 1% by weight of the cleaning composition;

an effective amount of a spore forming microbial composition; and an effective cleaning amount of a blend of wetting agents, the first wetting agent having a hydrophobic/lipophobic number (HLB) of about 10 and higher and a second wetting agent having an HLB number of about 5 or less.

6. The composition of claim 5 further comprising an effective disinfecting amount of a quaternary ammonium compound.

7. The composition of claim 6, wherein the ammonium compound is a dialkyl of from 6–18 carbon atoms, dialkyl of 1 to 4 carbon atoms ammonium compound.

8. A method of cleaning a soiled surface containing microbial flora comprising applying the composition of claim 1 to the surface and drying the surface thereby cleaning and disinfecting the surface.

9. A method of cleaning a soiled surface containing microbial flora comprising applying the composition of claim 5 to the surface thereby cleaning and disinfecting the surface.

10. The method of claim 8 wherein the soil on said soiled surface contains microbes, selected from the group consisting of *Staphylococcus aureus, Pseudomonas aeruginosa, Salmonella choleraesius* and *Escherichia coli.*

11. The method of claim 8 wherein the soil on said soiled surface is comprised of blood serum as an organic soil load.

12. The method of claim 8 wherein the composition further comprises an effective disinfecting amount of a quaternary ammonium compound.

13. The method of claim 12 wherein the ammonium compound is a dialkyl of from 6–18 carbon atoms, dialkyl of 1 to 4 carbon atoms ammonium compound.

14. The method of claim 8 wherein the spore forming microbial composition is a Bacillus material.

15. A powder cleaning and disinfecting composition which is added to water comprising:

an effective mineral dissolving amount of an organic acid of at least 1% by weight of the cleaning composition;

an effective amount of a spore forming microbial composition;

an effective cleaning amount of a blend of wetting agents, the first wetting agent having a hydrophobic/lipophobic number (HLB) of about 10 and higher and a second wetting agent having an HLB number of about 5 or less; and an effective amount of a thickening agent.

* * * * *

UNITED STATES PATENT AND TRADEMARK OFFICE

CERTIFICATE OF CORRECTION

PATENT NO. : 6,387,874 B1
DATED : May 14, 2002
INVENTOR(S) : Schalitz, William John et al.

It is certified that error appears in the above-identified patent and that said Letters Patent is hereby corrected as shown below:

Column 7,
Line 67, after "Those having an" delete "ILB" and insert therein -- HLB --.

Column 8,
Line 37, after "ethoxylated", delete "soyarnine" and insert therein -- soyamine --.

Column 9,
Line 10, after "oily soils and are" delete "jonically" and insert therein -- ionically --.

Column 10,
Lines 60-61, after "inventive" delete "composition" and insert therein -- compositions -- and, also after "below" insert therein -- and --.
Line 66, after "degrees" delete "centigrade" and insert therein -- fahrenheit --.

Signed and Sealed this

First Day of April, 2003

JAMES E. ROGAN
*Director of the United States Patent and Trademark Office*